US009460849B2

(12) United States Patent
Baba et al.

(10) Patent No.: US 9,460,849 B2
(45) Date of Patent: Oct. 4, 2016

(54) METHOD OF MANUFACTURING MAGNET AND MAGNET

(71) Applicant: JTEKT CORPORATION, Osaka-shi, Osaka (JP)

(72) Inventors: Toshiyuki Baba, Kashihara (JP); Koji Nishi, Anjo (JP); Fumiya Ito, Kani (JP)

(73) Assignee: JTEKT CORPORATION, Osaka-shi (JP)

( * ) Notice: Subject to any disclaimer, the term of this patent is extended or adjusted under 35 U.S.C. 154(b) by 498 days.

(21) Appl. No.: 13/923,842

(22) Filed: Jun. 21, 2013

(65) Prior Publication Data

US 2013/0342298 A1 Dec. 26, 2013

(30) Foreign Application Priority Data

Jun. 25, 2012 (JP) ..... 2012-141803

(51) Int. Cl.

| | |
|---|---|
| ***H01F 41/02*** | (2006.01) |
| ***C22C 1/04*** | (2006.01) |
| ***H01F 1/059*** | (2006.01) |
| ***H01F 1/06*** | (2006.01) |
| ***H01F 1/08*** | (2006.01) |
| ***H01F 1/01*** | (2006.01) |
| ***C22C 1/02*** | (2006.01) |

(52) U.S. Cl.

CPC ..... *H01F 41/0246* (2013.01); *C22C 1/02* (2013.01); *C22C 1/04* (2013.01); *H01F 1/017* (2013.01); *H01F 1/0596* (2013.01); *H01F 1/065* (2013.01); *H01F 1/08* (2013.01); *H01F 41/026* (2013.01)

(58) Field of Classification Search

None

See application file for complete search history.

(56) References Cited

U.S. PATENT DOCUMENTS

| | | | | |
|---|---|---|---|---|
| 4,968,529 | A | 11/1990 | Hamamura et al. | |
| 5,234,771 | A | 8/1993 | Mohri et al. | |
| 5,279,785 | A | 1/1994 | Mohri et al. | |
| 5,886,077 | A * | 3/1999 | Takahashi | C08K 3/08 148/101 |
| 6,317,020 | B1 | 11/2001 | Nakagawa et al. | |
| 2002/0144753 | A1 * | 10/2002 | Yoshimura | H01F 41/026 148/101 |
| 2002/0197512 | A1 | 12/2002 | Aizawa et al. | |
| 2003/0062097 | A1 | 4/2003 | Shimada et al. | |
| 2009/0081067 | A1 | 3/2009 | Nakamura | |
| 2010/0261038 | A1 | 10/2010 | Imaoka et al. | |
| 2010/0289366 | A1 | 11/2010 | Komuro et al. | |

(Continued)

FOREIGN PATENT DOCUMENTS

| | | |
|---|---|---|
| CN | 101447330 A | 6/2009 |
| EP | 0 481 224 A1 | 4/1992 |

(Continued)

OTHER PUBLICATIONS

Jul. 8, 2013 Partial European Search Report issued in European Application No. 13156391.8.

(Continued)

*Primary Examiner* — George Wyszomierski
*Assistant Examiner* — Ngoclan T Mai
(74) *Attorney, Agent, or Firm* — Oliff PLC

(57) ABSTRACT

A method of manufacturing a magnet from material powders made of a R—Fe—N compound that contains a rare earth element as R or material powders made of a Fe—N compound, includes: an oxide film bonding step in which a compact is formed by bonding the material powders to each other by oxide films formed on surfaces of the material powders; and a coating step in which a surface of the compact is covered with a coating film.

8 Claims, 4 Drawing Sheets

(56) References Cited

U.S. PATENT DOCUMENTS

| | | | |
|---|---|---|---|
| 2011/0227424 | A1 | 9/2011 | Yoshida et al. |
| 2011/0267167 | A1 | 11/2011 | Ogawa et al. |
| 2013/0222093 | A1 | 8/2013 | Sugiyama et al. |
| 2013/0222094 | A1 | 8/2013 | Baba et al. |
| 2014/0374643 | A1 | 12/2014 | Mio et al. |

FOREIGN PATENT DOCUMENTS

| | | | |
|---|---|---|---|
| EP | 2 228 808 | A1 | 9/2010 |
| EP | 2 631 918 | A2 | 8/2013 |
| EP | 2 680 280 | A1 | 1/2014 |
| JP | A-60-54406 | | 3/1985 |
| JP | 62-206801 | A | 9/1987 |
| JP | A-63-217601 | | 9/1988 |
| JP | A-63-254702 | | 10/1988 |
| JP | H10-72603 | A | 3/1998 |
| JP | 2000-034503 | A | 2/2000 |
| JP | 2000-104104 | A | 4/2000 |
| JP | 2004-319602 | A | 11/2004 |
| JP | A-2005-223263 | | 8/2005 |
| JP | 2007-039794 | A | 2/2007 |
| JP | 2007-129105 | A | 5/2007 |
| JP | 2009-076755 | A | 4/2009 |
| JP | 2011-091313 | A | 5/2011 |
| JP | 2011-249774 | A | 12/2011 |
| JP | 2012-069962 | A | 4/2012 |
| WO | WO 2010/071111 | A1 | 6/2010 |

OTHER PUBLICATIONS

Jul. 8, 2013 Partial European Search Report issued in European Application No. 13156393.4.

Nov. 7, 2013 Extended European Search Report issued in European Application No. 13156391.8.

Nov. 7, 2013 Extended European Search Report issued in European Application No. 13156393.4.

Dec. 5, 2014 Extended European Search Report issued in European Application No. 14173515.9.

Jun. 25, 2015 Office Action issued in U.S. Appl. No. 13/778,608.

Sep. 4, 2015 Restriction Requirement issued in U.S. Appl. No. 13/771,887.

Extended European Search Report issued in European Application No. 13173244.8 mailed Oct. 31, 2013.

Partial European Search Report issued in European Patent Application No. 13173244.8 on Jul. 24, 2013.

Feb. 23, 2016 Notice of Reasons for Rejection issued in Japanese Application No. 2012-141803.

Mar. 23, 2016 First Office Action issued in Chinese Application No. 201310045955.4.

* cited by examiner

METHOD OF MANUFACTURING MAGNET AND MAGNET

INCORPORATION BY REFERENCE

The disclosure of Japanese Patent Application No. 2012-141803 filed on Jun. 25, 2012 including the specification, drawings and abstract, is incorporated herein by reference in its entirety.

BACKGROUND OF THE INVENTION

1. Field of the Invention

The invention relates to a method of manufacturing a magnet, and a magnet.

2. Description of Related Art

Neodymium magnets (Nd—Fe—B magnets) have been used as high performance magnets. However, dysprosium (Dy), which is expensive and rare, is used to manufacture high performance neodymium magnets. Therefore, development of magnets that are manufactured without using dysprosium has been promoted recently.

Sm—Fe—N magnets that are manufactured without using dysprosium are known. However, because the decomposition temperature of a Sm—Fe—N compound is low, it is difficult to subject the Sm—Fe—N compound to sintering. If the Sm—Fe—N compound is sintered, the temperature of the Sm—Fe—N compound becomes equal to or higher than the decomposition temperature and the compound is decomposed. This may cause a possibility that the magnet will not be able to exhibit its performance as a magnet. Thus, usually, material powders of the compound are bonded by a bonding agent. However, using the bonding agent causes a decrease in the density of the material powders of the magnet, which may be a factor of a decrease in the residual magnetic flux density.

Japanese Patent Application Publication No. 2005-223263 describes manufacturing a rare earth permanent magnet by forming oxide films on Sm—Fe—N compound powders, forming the compound powders into a compact having predetermined shape through compression preforming performed in a non-oxidative atmosphere, and then consolidating the compact at a temperature of 350° C. to 500° C. in a non-oxidative atmosphere. In this way, it is possible to manufacture a Sm—Fe—N magnet at a temperature lower than the decomposition temperature.

Japanese Patent Application Publication No. 60-54406 (JP 60-54406 A), Japanese Patent Application Publication No. 63-217601 (JP 63-217601 A) and Japanese Patent Application Publication No. 63-254702 (JP 63-254702 A) describe forming an oxidation-resistant plated layer on the surface of a permanent magnet formed by sintering, forming an oxidation-resistant resin layer on the surface of a permanent magnet formed by sintering, and applying base metal non-electrolytic plating to the surface of a permanent magnet formed by sintering after formation of a noble metal thin film.

However, the bonding strength of material powders of the magnet manufactured according to the method described in JP 2005-223263 A is lower than that of a magnet manufactured by sintering or manufactured with the use of a bonding agent. Accordingly, the magnet manufactured according to the method described in JP 2005-223263 A does not have a high bending strength. JP 60-54406 A, JP 63-217601 A, and JP 63-254702 A describe the methods in which magnets are formed by sintering. Therefore, forming Sm—Fe—N magnets according to these methods is difficult. Note that, the plated layer and the resin layer are employed in order to obtain sufficient oxidation resistance and corrosion resistance.

SUMMARY OF THE INVENTION

It is an object of the invention to provide a method of manufacturing a magnet with which a high residual magnetic flux density is obtained, without using a bonding agent, and with which a high bending strength is obtained, and a magnet.

An aspect of the invention relates to a method of manufacturing a magnet from material powders made of a R—Fe—N compound that contains a rare earth element as R or material powders made of a Fe—N compound, the method including: an oxide film bonding step in which a compact is formed by bonding the material powders to each other by oxide films formed on surfaces of the material powders; and a coating step in which a surface of the compact is covered with a coating film.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
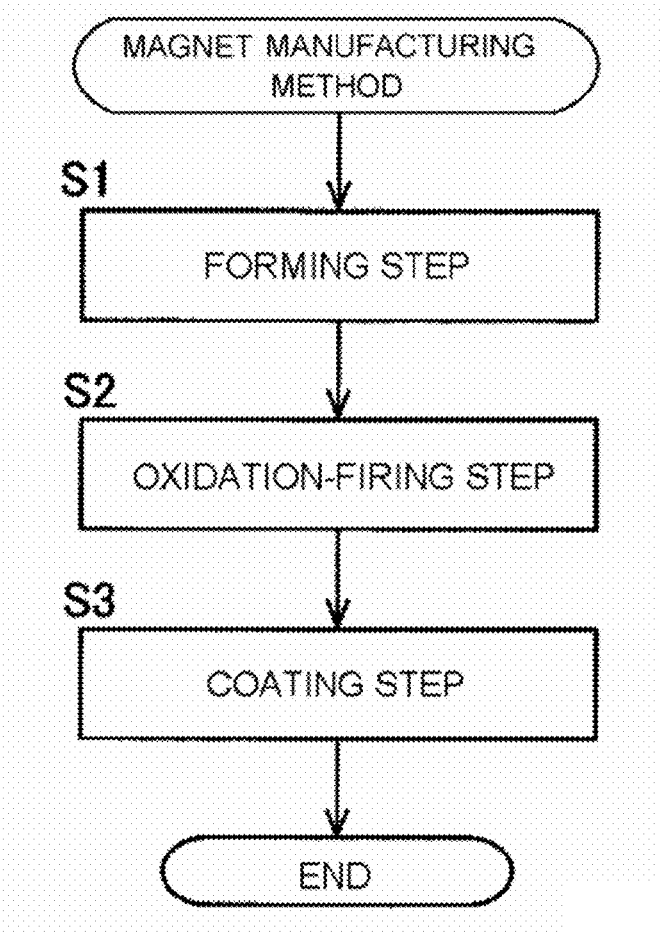
FIG. 1 is a flowchart for describing a method of manufacturing a magnet according to an embodiment of the invention.
Figure 2:
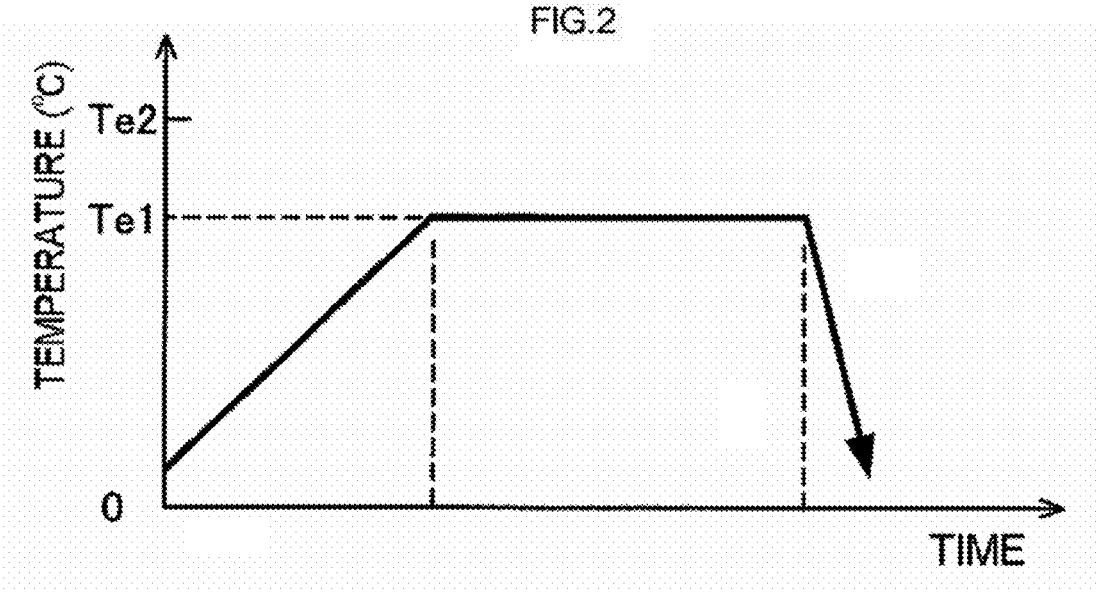
FIG. 2 is a graph showing a heat treatment process in an oxidation-firing step shown in FIG. 1.
Figure 3:
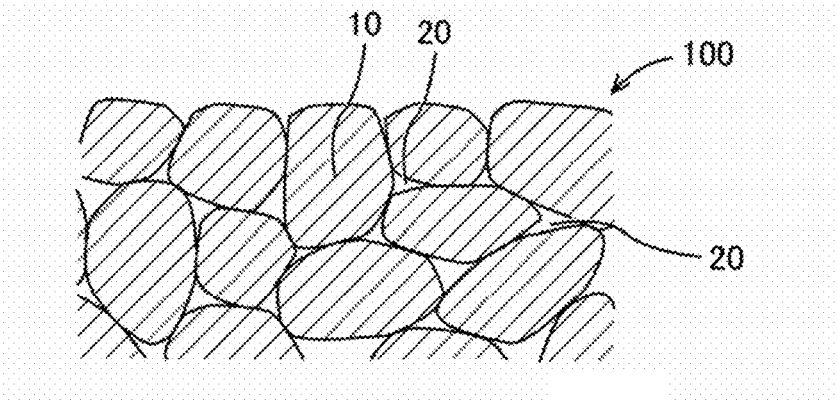
FIG. 3 is a schematic sectional view illustrating the microscopic structure before the oxidation-firing step shown in FIG. 1.

Hereinafter, a method of manufacturing a magnet according to an embodiment of the invention will be described with reference to FIG. 1 to FIG. 5. As shown in FIG. 1 and FIG. 3, material powders 10 used to manufacture the magnet are formed into a primary compact 100 having a predetermined shape through compression forming (step S1: forming step). A R—Fe—N compound that contains a rare earth element as R, or a Fe—N compound is used as the material powders 10 used to manufacture the magnet. Rare earth elements other than dysprosium, such as light rare earth elements, are preferably used as the rare earth element R. Among light rare earth elements, Sm is particularly preferable. Note that, in this specification, the light rare earth elements are lanthanoid elements having an atomic weight smaller than that of Gd, namely, La, Ce, Pr, Nd, Pm, Sm, Eu. $Sm_2Fe_{17}N_3$ or $Fe_{16}N_2$ is preferably used as the material powders 10 used to manufacture the magnet. Because no dysprosium is used, the magnet is manufactured at low costs. Further, as the material powders 10, material powders having no oxide films on their surfaces are used.

FIG. 3 is a schematic sectional view showing the microscopic structure of the primary compact 100. In the primary compact 100 formed in the forming step, the material powders 10 are not deformed at all or deformed just slightly due to compression. Accordingly, although the material powders 10 are partially contact each other, clearances 20 are formed between the material powders 10. Preferably, the primary compact 100 is formed in an oxidative atmosphere in order to allow oxidizing gas to enter the clearances 20. Note that, adhesive agents such as a bonding, agent are not used in the forming step. Therefore, the bonding strength of the material powders 10 is low.

When the material powders 10 made of, for example, $Sm_2Fe_{17}N_3$ are used, the average particle diameter of the material powders 10 is approximately 3 μm and the primary compact 100 has a minimum thickness of approximately 2 mm, and a pressure applied to form the primary compact 100 is approximately 50 MPa. Further, when the material powders 10 made of $Fe_{16}N_2$ are used, manufacturing parameters substantially equal to those for the material powders 10 made of $Sm_2Fe_{17}N_3$ may be used.

Figure 4:
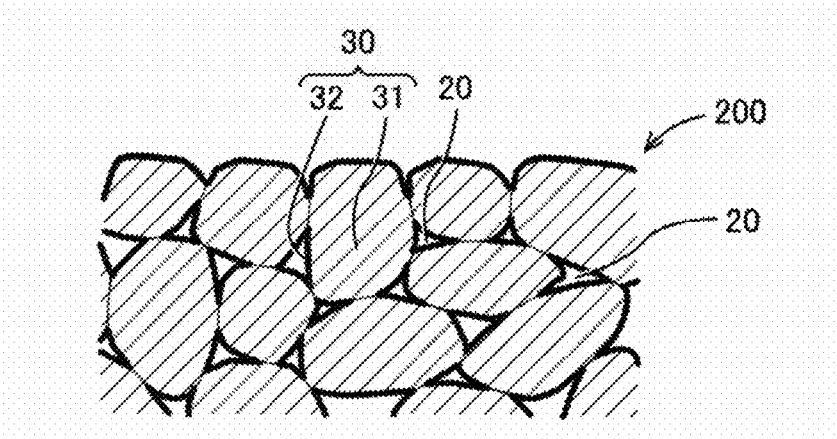
FIG. 4 is a schematic sectional view illustrating the microscopic structure after the oxidation-firing step shown in FIG. 1.

Next, as shown in FIG. 1 and FIG. 4, the primary compact 100 formed in the forming step is heated in an oxidative atmosphere to form a secondary compact 200 in which the material powders 30 are bonded to each other by oxide films 32 (step S2: oxidation-firing step, oxide film bonding step). The oxidation-firing step is carried out with the primary compact 100 placed in a heating furnace in which heating is performed using microwaves, an electric furnace, a plasma furnace, a high frequency heating furnace, a heating furnace in which heating is performed using an infrared heater or the like. The heat treatment process in the oxidation-firing step is as shown in FIG. 2.

A heating temperature Te1 is set lower than a decomposition temperature Te2 of compound material powders. For example, when the material powders 10 of $Sm^2Fe_{17}N_3$ are used, the heating temperature Te1 is set lower than 500° C. because the decomposition temperature Te2 of the compound is approximately 500° C. For example, the heating temperature Te1 is set to approximately 200° C. The same applies to the case where the material powders of $Fe_{16}N_2$ are used.

Further, the oxygen density and the gas pressure of the oxidative atmosphere are not particularly limited as long as the material powders are oxidized. The oxygen density and the gas pressure of the oxidative atmosphere may be substantially equal to the oxygen density in the atmospheric air and the atmospheric pressure, respectively. Thus, it is not necessary to particularly control the oxygen density and the gas pressure. Accordingly, the material powders may be heated in an atmosphere of the atmospheric air. Further, by setting the heating temperature Te1 to approximately 200° C., oxide films are formed regardless of whether the material powders of $Sm_2Fe_{17}N_3$ are used or the material powders of $Fe_{16}N_2$ are used.

FIG. 4 is a schematic sectional view showing the microscopic structure of the secondary compact 200 after the oxidation-firing step. By heating the primary compact 100 in the oxidative atmosphere, exposed faces of the material powders 30 chemically react with oxygen, and as a result, oxide films 32 (as indicated by the bold lines in FIG. 4) are formed. The oxide films 32 bond adjacent material powders 30 to each other, and accordingly, a sufficient strength of the secondary compact 200 is ensured.

As shown in FIG. 3, in the primary compact 100 before the oxidation-firing step, the material powders 10 are partially contact each other, and the clearances 20 are formed between the material powders 10. In the secondary compact 200 after the oxidation-firing step, the oxide films 32 are formed on the material powders at their outer face sides exposed to the clearances 20, and the oxide films 32 bond adjacent material powders 30 to each other. That is, the oxide films 32 are formed on the parts of the material powders 30, which are exposed to the clearances 20, while the parts of the material powders 30, which are not exposed to the clearances 20, are used as a base material 31. Thus, the oxide film 32 is not formed on the entirety of the outer face of each material powder 30. Because the amount of the oxide films 32 is set to the smallest possible amount at which a sufficient bonding strength of the material powders 30 is ensured, it is possible to suppress a decrease in the residual magnetic flux density of the magnet due to formation of the oxide films 32. Therefore, it is possible to manufacture a magnet which is inexpensive and which exhibits a high performance.

Figure 5:
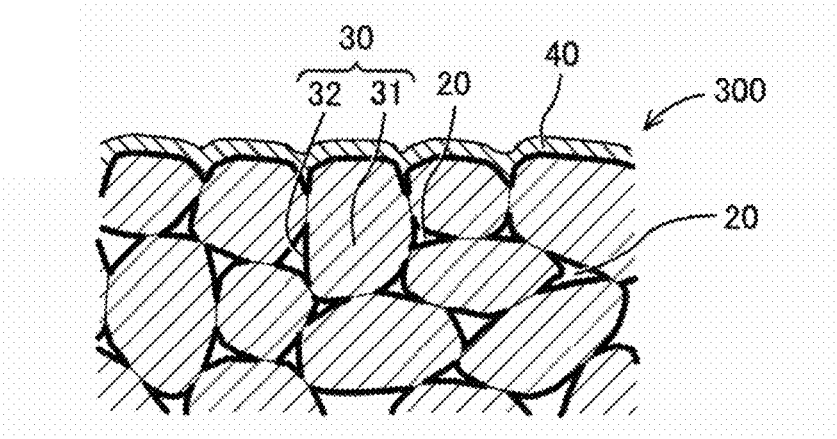
FIG. 5 is a schematic sectional view illustrating the microscopic structure after a coating step.

Then, as shown in FIG. 1 and FIG. 5, a process for covering the surface of the secondary compact 200, which is formed in the oxidation firing step, with a coating film 40, is carried out in order to form a tertiary compact 300 (step S3: coating step). The coating film 40 of the tertiary compact 300 is a plating film formed by electroplating with a metal such as Cr, Zn, Ni, Ag or Cu, a plating film formed by non-electrolytic plating, a resin film formed by resin coating, a glass film formed by glass coating, a film made of Ti, diamond-like carbon (DLC), or the like. An example of the non-electrolytic plating is a non-electrolytic plating in which Ni, Au, Ag, Cu, Sn, Co, or an alloy or a mixture of these metals is used. An example of the resin coating is a coating with silicon resin, fluorine resin, urethane resin, or the like.

The coating film 40 formed on the tertiary compact 300 has a function like an eggshell. Therefore, the bending strength of the tertiary compact 300 is increased because the oxide films 32 and coating film 40 ensure high bonding strength. In particular, by applying the non-electrolytic plating, the surface hardness and adhesion are increased and the bonding strength of the material powders 30 is further increased. Further, for example, non-electrolytic nickel phosphorous plating provides a sufficient corrosion resistance.

Further, the oxide films 32 bond the material powders 30 to each other not only on the outer face of the secondary compact 200 but also in the inner part of the secondary compact 200. Accordingly, the bonding strength provided by the oxide films 32 restricts free movement of the material powders 30 within the tertiary compact 300. Thus, it is possible to suppress magnetic pole reversal due to rotation of the material powders 30. Therefore, the thus manufactured magnet has a high residual flux density.

In the case where electroplating is applied in the coating step, the bonding strength in the secondary compact 200 needs to be high because the secondary compact 200 before plating serves as an electrode. However, in the case where non-electrolytic plating, resin coating or glass coating is applied in the coating step, the bonding strength in the secondary compact 200 need not be higher than that in the case of electroplating. That is, the oxide films 32 provide sufficient bonding strength. As a result, the coating, film 40 is reliably formed on the outer face of the secondary compact 200 in the coating step as described above.

In the case where non-electrolytic plating is applied in the coating step, the secondary compact 200 is impregnated with a plating solution. At this time, the plating solution attempts to enter the inside of the secondary compact 200. However, because the oxide films 32 are formed, the oxide films 32 restrict entry of the plating solution into the inside of the secondary compact 200. Therefore, reduction of the occurrence of for example, corrosion due to entry of the plating solution into the inside of the secondary compact 200 is expected.

Further, according to the manufacturing method as described above, in the case where a R—Fe—N compound containing, as R, a rare earth element other than dysprosium or a Fe—N compound, a magnet is manufactured at low costs because dysprosium is not used. Thus, a magnet is manufactured at low cost. Further, because the R—Fe—N compound and the Fe—N compound each have as low decomposition temperature, it is difficult to apply high temperature sintering. However, because the compound is heated at a temperature lower than its decomposition temperature Te2 in the oxidation-firing step, it is possible to prevent the compound from being decomposed. Thus, it is possible to prevent a decrease in the residual magnetic flux density of the magnet due to decomposition of the compound. As a result, it is possible to reliably manufacture a magnet having a high residual magnetic flux density. Further, the material powders are bonded to each other not by a bonding agent but by the oxide films 32 and coating film 40. Therefore, the residual magnetic flux density is higher than that in the case where a bonding agent is used.

Working Example $Sm_2Fe_{17}N_3$ manufactured by Nichia Corporation and described in Japanese Patent Application Publication No. 2000-104104 was used as the material powders. Specifically, $Sm_2Fe_{17}N_3$ having an average particle diameter of 3 μm was used as the material powders. The material powders were then pressed in a cold-forming step by a magnetic field orientation press under a pressure of 50 MPa to form a compact having a shape of a rectangular parallelepiped of 10 mm×30 mm×2 mm. Then, in the oxidation-firing step, the thus formed compact was heated in an atmosphere of the atmospheric air within an electric furnace. In the heat treatment process, the heating temperature Te1 was 200° C. and the temperature increase rate was 2.25° C./min.

Figure 6:
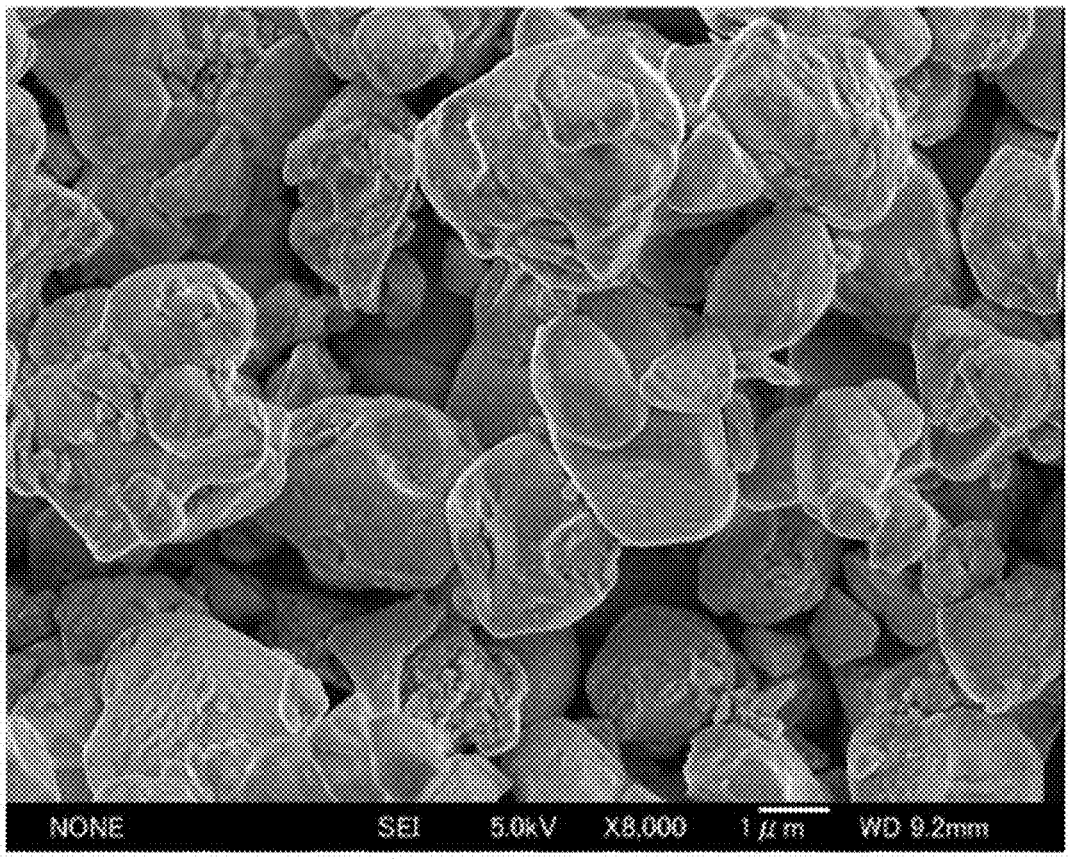
FIG. 6 is a microphotograph (×8000) illustrating an outer face before the oxidation-firing step in the embodiment.
Figure 7:
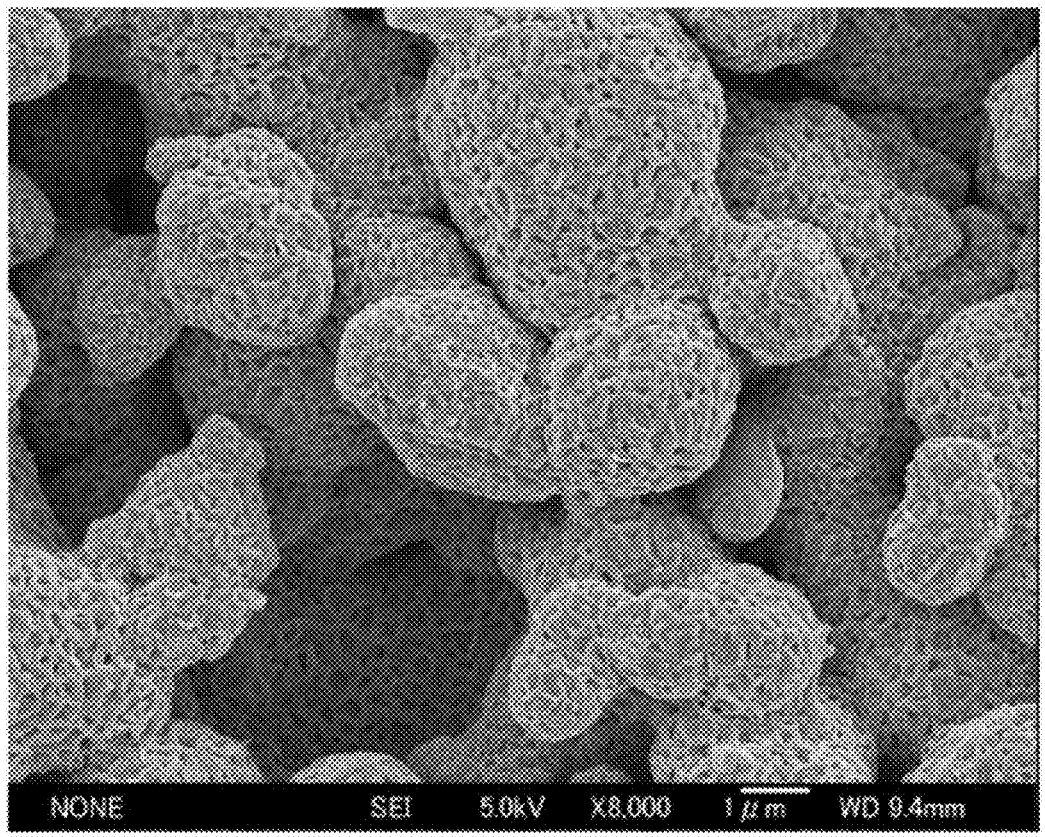
FIG. 7 is a microphotograph (×8000) illustrating the outer face after the oxidation-firing step in the embodiment.

In the case where the magnet is manufactured as described above, a photograph of the outer face of the primary compact 100 before the oxidation firing step is as shown in FIG. 6, and a photograph of the outer face of the secondary compact 200 after the oxidation firing step but before the coating step is as shown in FIG. 7. A comparison between FIG. 6 and FIG. 7 indicates that each of the material powders in the primary compact 100 shown in FIG. 6 has an outer face with less unevenness, whereas each of the material powders in the secondary compact 200 shown in FIG. 7 has an outer face on which netlike ridges are developed. It is considered that the netlike ridges constitute the oxide films 32. Further, it is understood that the netlike ridges shown in FIG. 7 bond the adjacent material powders to each other. Thus, the material powders 10 are integrally bonded to each other by the oxide films 32.

Figure 8:
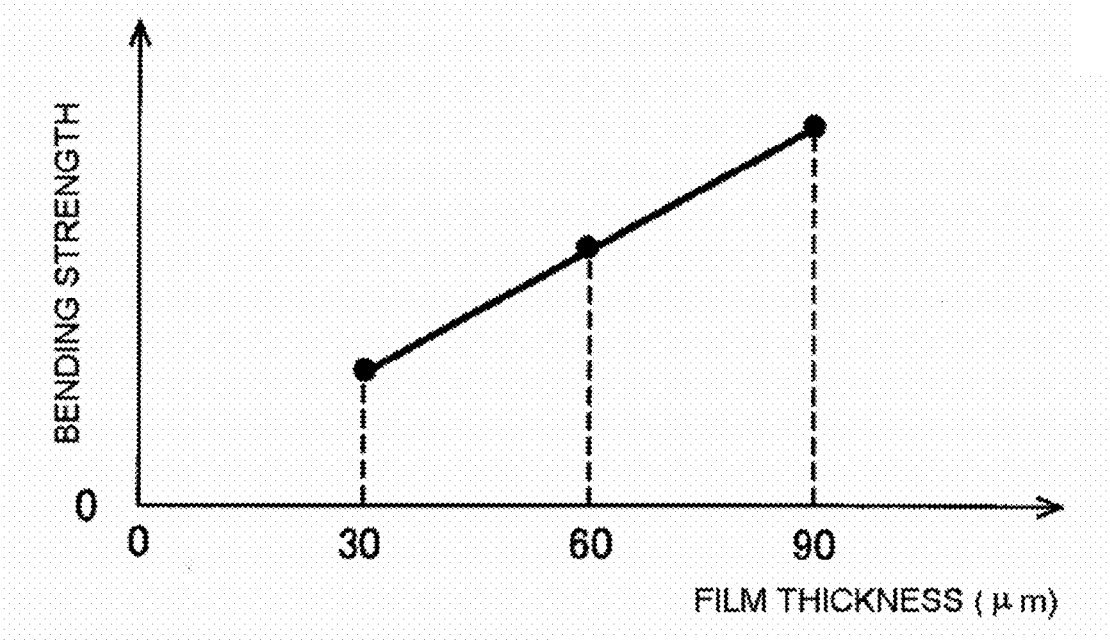
FIG. 8 is a graph showing the relationship between the thickness of a coating film and the bending strength.

Further, the secondary compact 200 obtained as described above was non-electrolytic plated with nickel to form a nickel phosphorous plating film. Then, the bending strengths when the thicknesses of nickel phosphorous plating films were 30 μm, 60 μm and 90 μm were measured. The results of the measurements are shown in FIG. 8. As shown in FIG. 8, it is understood that the thicker the nickel phosphorous plating film is, the higher the bending strength is.

Alternative Example

In the embodiment described above, as the material powders 10, material powders having no oxide films on their surfaces are used, and the oxide films 32 are formed in the oxidation-firing step. Alternatively, material powders having oxide films formed on their surfaces in advance may be used as the material powders 10. In this case, a primary compact is formed from the material powders having the oxide films, and is then heated at a temperature lower than a decomposition temperature. Thus, the oxide films are bonded to each other. Then, a coating step is performed so that the surface of the compact is covered with a coating film.

In this case, because the film is formed on the entirety of the outer face of each of the material powders, the residual magnetic flux density is lower than that in the above-described embodiment. However, the residual magnetic flux density is higher than that in the case where a bonding agent is used. Further, with the formation of the coating films, a high bending strength is obtained as in the above-described embodiment.

What is claimed is:

1. A method of manufacturing a magnet from material powders made of a R—Fe—N compound that contains a rare earth element as R or material powders made of a Fe—N compound, the method comprising:

forming a primary compact having a predetermined shape by compression forming the material powders;

heating the primary compact in an oxidative atmosphere to bond the material powders to each other by oxide films that form on surfaces of the material powders to obtain a secondary compact; and covering a surface of the secondary compact with a coating film.

2. The method of manufacturing a magnet according to claim 1, wherein the coating film is formed by plating.

3. The method of manufacturing a magnet according to claim 2, wherein the coating film is formed by non-electrolytic plating.

4. The method of manufacturing a magnet according to claim 3, wherein the rare earth element R is Sm.

5. The method of manufacturing a magnet according to claim 2, wherein the rare earth element R is Sm.

6. The method of manufacturing a magnet according to claim 1, wherein the compact is heated at a temperature lower than a decomposition temperature of the R—Fe—N compound or the Fe—N compound in the oxidation-firing step.

7. The method of manufacturing a magnet according to claim 6, wherein the rare earth element R is Sm.

8. The method of manufacturing a magnet according to claim 1, wherein the rare earth element R is Sm.

* * * * *